United States Patent [19]

Firth

[11] 4,352,106

[45] Sep. 28, 1982

[54] RADAR REFLECTORS

[76] Inventor: John H. Firth, 15, The Gowers, Harlow, Essex, England

[21] Appl. No.: 184,237

[22] Filed: Sep. 5, 1980

[30] Foreign Application Priority Data

Sep. 17, 1979 [GB] United Kingdom ..... 7932216

[51] Int. Cl.[3] ..... H01Q 15/18

[52] U.S. Cl. ..... 343/18 C

[58] Field of Search ..... 343/18 C

[56] References Cited

U.S. PATENT DOCUMENTS 2,721,998 10/1955 Holm ..... 343/18 C 4,028,701 6/1977 Parks et al. ..... 343/18 C

FOREIGN PATENT DOCUMENTS 171748 6/1960 Sweden ..... 343/18 C 681666 10/1952 United Kingdom ..... 343/18 C

*Primary Examiner*—Malcolm F. Hubler

*Attorney, Agent, or Firm*—Emory L. Groff, Jr.

[57] ABSTRACT

In order to provide coverage of a full 360 degrees of azimuth even when heeled a radar reflector consists of ten trihedral reflectors directed outwardly of a major axis the inner eight of which are formed in vertically displaced pairs of dihedral reflectors sub-divided by a divider portion which reflectors are positioned such that the apexes of the two central dihedral reflectors are relatively displaced about the major axis by an angle a and the apexes of the dihedral reflectors on each side of the central reflectors are displaced relative to the nearest apex of a central dihedral reflector each by an angle different to a, the arrangement being such that the spacing between the central axes of reflection of adjacent trihedral reflectors is in the range 25 degrees to 45 degrees. The reflector is suitable for use on small boats and other vessels and marine buoys.

10 Claims, 11 Drawing Figures

Figure 1:
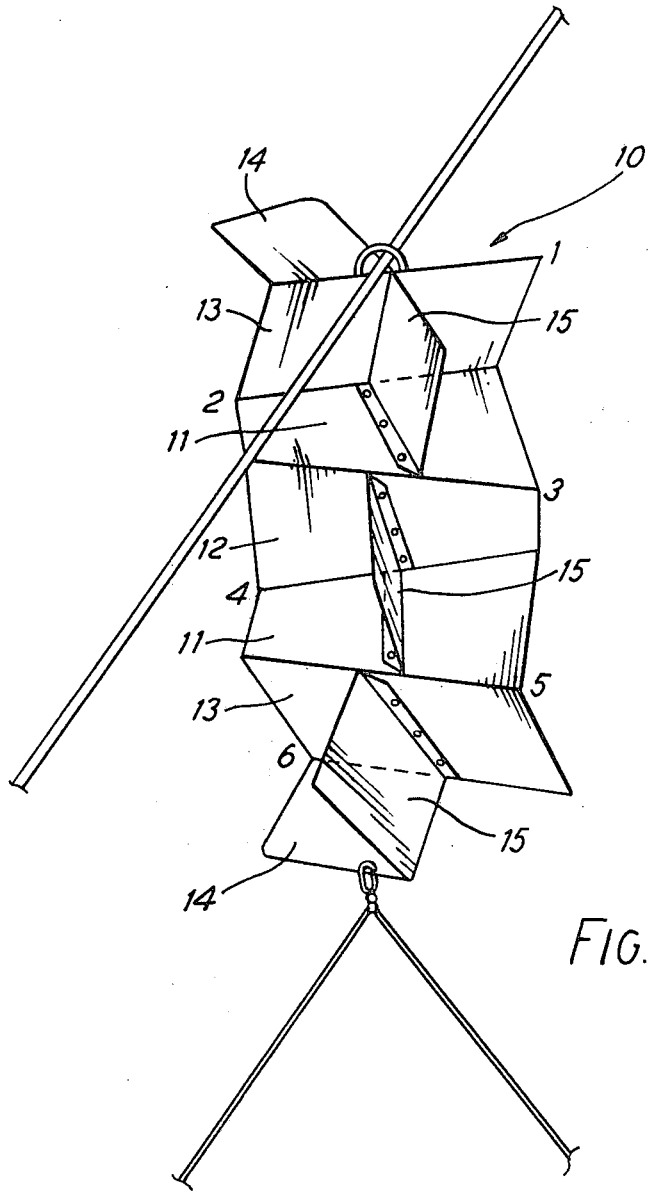

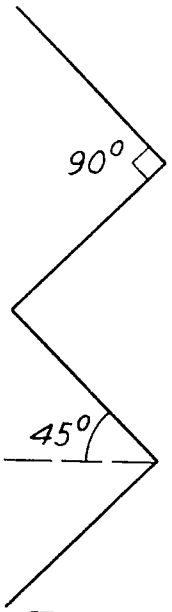
FIG. 5a
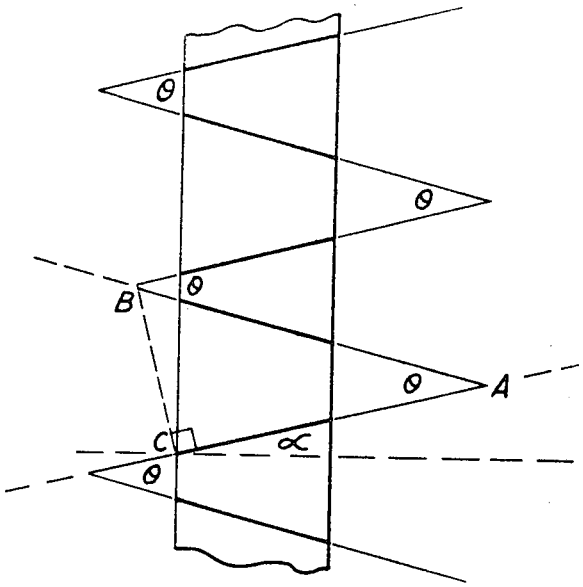
FIG. 5b
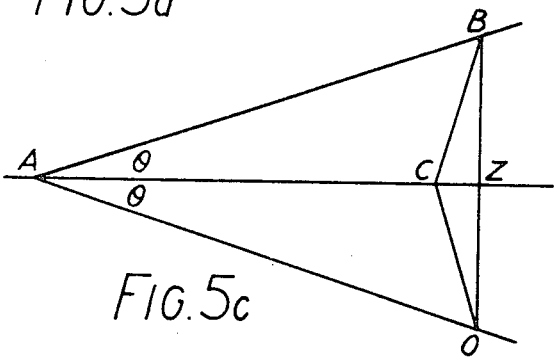
FIG. 5c
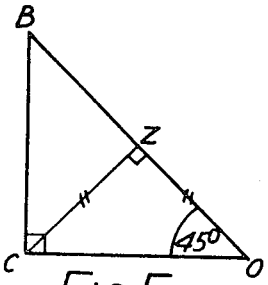
FIG. 5f
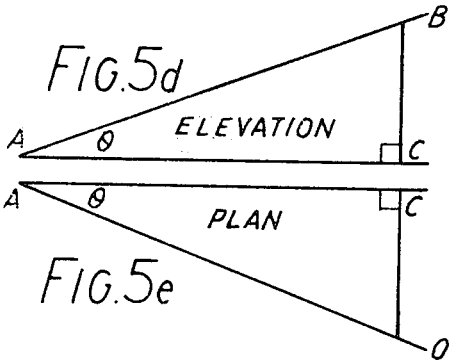
FIG. 5d
FIG. 5e
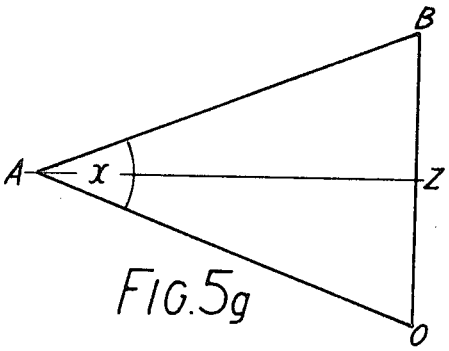
FIG. 5g

RADAR REFLECTORS

This invention relates to passive radar reflectors, in particular, but not solely, to such reflectors for use on small boats and other vessels proceeding to sea, and on marine buoys.

Radar reflectors are necessary to improve the radar echoing area characteristics of objects, or land formations, to make them more readily detected by radar scanning equipment particularly when conditions are adverse to such detection. To be effective all such reflectors must return the scanning radar waves parallel to the initial direction from which they arrive and, in many applications, must be capable of reflecting a signal received from any direction. Where reflectors are in use at sea this capability must be retained when there is heeling of the object on which the reflector is mounted e.g. by wave motion, wind effects, or by tidal action.

Corner reflectors constructed of three sheets of radar reflective material which are mutually perpendicular, i.e. orthogonal re-entrant trihedrals, are known to provide reflection over a range of angles of incidence the measured reflected signal strength from such corners decreasing as the obliquity increases, forming a lobe. The 'centre line' of such a trihedral reflector, about which the optimum reflective response arises, is 35 degrees to each of the three plane surfaces which form the corner. The greater the angle of approach the scanning beam makes to this centre line the more the reflected energy falls away. A plot of points of equal reflective signal energy produces a cone like form having a rounded base. This cone is known to be an hexagonal shape the sides of which correspond to the three plane faces forming the corner and their points of intersection. The angle of the cone measured from the point of peak reflection to points of power six decibels lower than that measured at the peak is approximately 36 degrees solid angle and this is the useful coverage from such corners whose response rapidly falls away to become ineffective over the next few degrees of divergence.

The performance of a re-entrant trihedral corner is directly related to radar cross sectional area and a corner with all three sides equally displayed to the scanning beam may be regarded as presenting a hexagonal area three sides of which correspond to the three plane surfaces making up the corner, the other three sides being perpendicular to the lines intersecting the three surfaces.

The reflective properties of such re-entrant trihedral corners have been known and used for many years on seagoing vessels and marine buoys etc. in attempting to provide an effective radar response over 360 degrees azimuth. In particular the "Octahedral Reflector" has been in common use.

This reflector normally comprises three sheets of metal assembled to form eight orthogonal trihedral corners. To return its best azimuthal response this type of reflector must be suspended in a so called "catchwater" position with one corner directed vertically upwards and an opposite corner directed vertically downwards the remainder of the corners being directed outwardly around the vertical axis at angles alternately above and below the horizontal with its optimum line of reflection eighteen degrees above or below the horizontal. Placed on a table an octahedral reflector takes up the "catchwater" position.

It will be readily understood, that with only six corners each having about 36 degrees "lobe diameter" inclined above and below the horizontal by more than 18 degrees, there will be significant gaps in the reflective capability of this construction the reflection falling away completely in certain directions when affected by a few degrees of heeling.

There are other constructions in common use on buoys which employ individually constructed corner reflectors on one common plane positioned with their reflective faces directed outwardly circularly around a central axis. Their construction, weight, and the size of corner necessary prevents their use on small vessels and buoys.

A folded metal construction known as the AGA Reflector (British Patent Specification No. 681 666) seeks to overcome the disadvantages of the previous mentioned constructions by providing a large number of reflective corners along a single major axis such that the corners are directed outwardly and around the axis. The disclosed construction employs eighteen corners which, due to the number and disposition around the axis, gives rise to mutual interference between the multiple reflections, which the many elements, of which it is comprised, return, leading to an overall performance which has been found unacceptable in use.

I have looked at the deficiencies of the reflectors referred to above, along with the construction and characteristics of other types which are well known and directed my efforts towards overcoming them.

My approach has been to reduce the number of corners to ten, covering 360 degrees azimuth with constant disposition of the corners to avoid gaps in response between adjacent lobes, and overlapping of lobes so that overall performance is not seriously affected by wave path phase cancellations. I have also exploited the advantages to be gained from the reflections which arise from two plates at right angles to each other whilst discarding the area which lies outside the hexagonal response and the points of intersection of the component sides of a standard corner.

The problem of providing a symmetrical response to the azimuth was overcome in the construction detailed in my British Patent Application No. 29923/77 by arranging dihedral folds so as to locate ten corner reflectors along two successive and opposite twisting helical axes (dextrorse and sinistrorse) thereby distributing the lobes of response without overlap or gaps by using five corners on each axis. This arrangement has resulted in an excellent measured polar response with gains arising from glint giving an overall performance superior to prior constructions and has been found to be very effective in use at sea on small sailing vessels.

However, the lobes of reflection related to the before mentioned construction are inclined above and below the horizontal at angles greater than desired and the dihedral areas are much less effective than if the folds were at a smaller inclination. This invention seeks to reduce these effects and to provide increased efficiency without loss of the necessary overall azimuthal cover required by the maritime authorities.

According to the invention there is provided a radar reflector consisting of ten trihedral reflectors directed outwardly of a major axis the inner eight of which are formed in vertically displaced pairs of dihedral reflectors subdivided by a divider portion which reflectors are positioned such that the apexes of the two central dihedral reflectors are relatively displaced about the major axis by an angle a and the apexes of the dihedral reflectors on each side of the central reflectors are displaced relative to the nearest apex of a central dihedral reflector each by an angle different to a, the arrangement being such that the reflectors cover the full azimuth of 360 degrees and the azimuthal spacing between the central axes of reflection of adjacent trihedral reflectors is in the range of 25 degrees to 45 degrees.

By adopting this angular spacing defined the reflector will comply with the performance requirements of the British Department of Trade Marine Radar Reflector Performance Specification of April 1977 and insures that the gap between effective lobes of reflection from adjacent corners does not exceed 10 degrees and no excessive overlapping occurs.

The apex of the dihedral reflectors on each side of the central reflectors are preferably displaced relative to the nearest apex of a central dihedral reflector by the same angle b. In a preferred form of the invention angle a falls within the range 10 degrees to 20 degrees with angle a plus twice the angle b falling within the range 68 degrees to 73 degrees.

Figure 2:
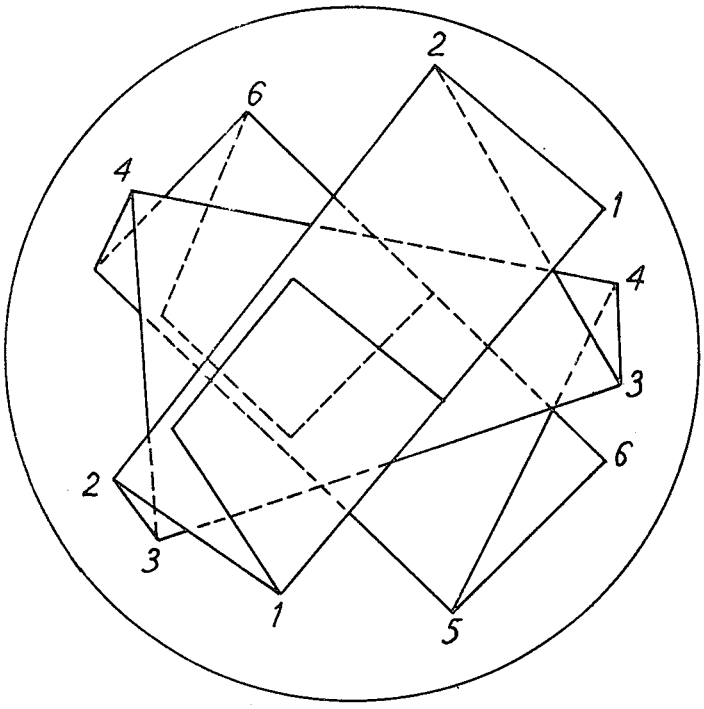
Figure 3:
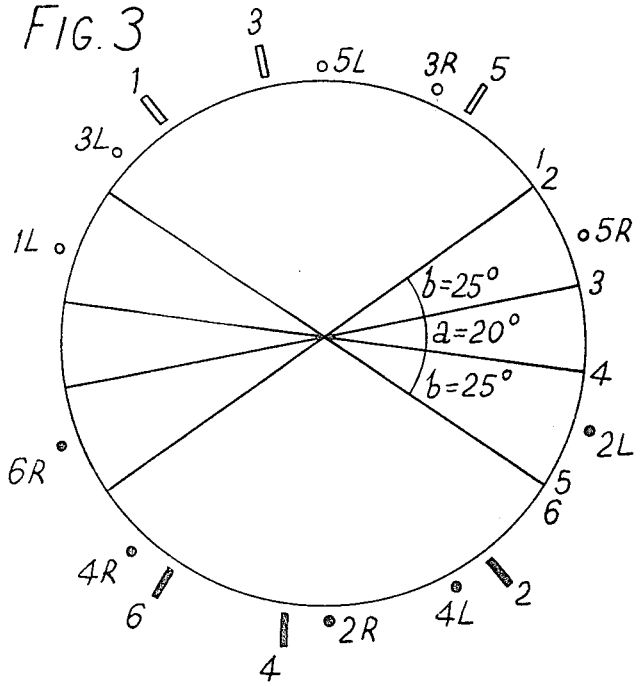
Figure 4:
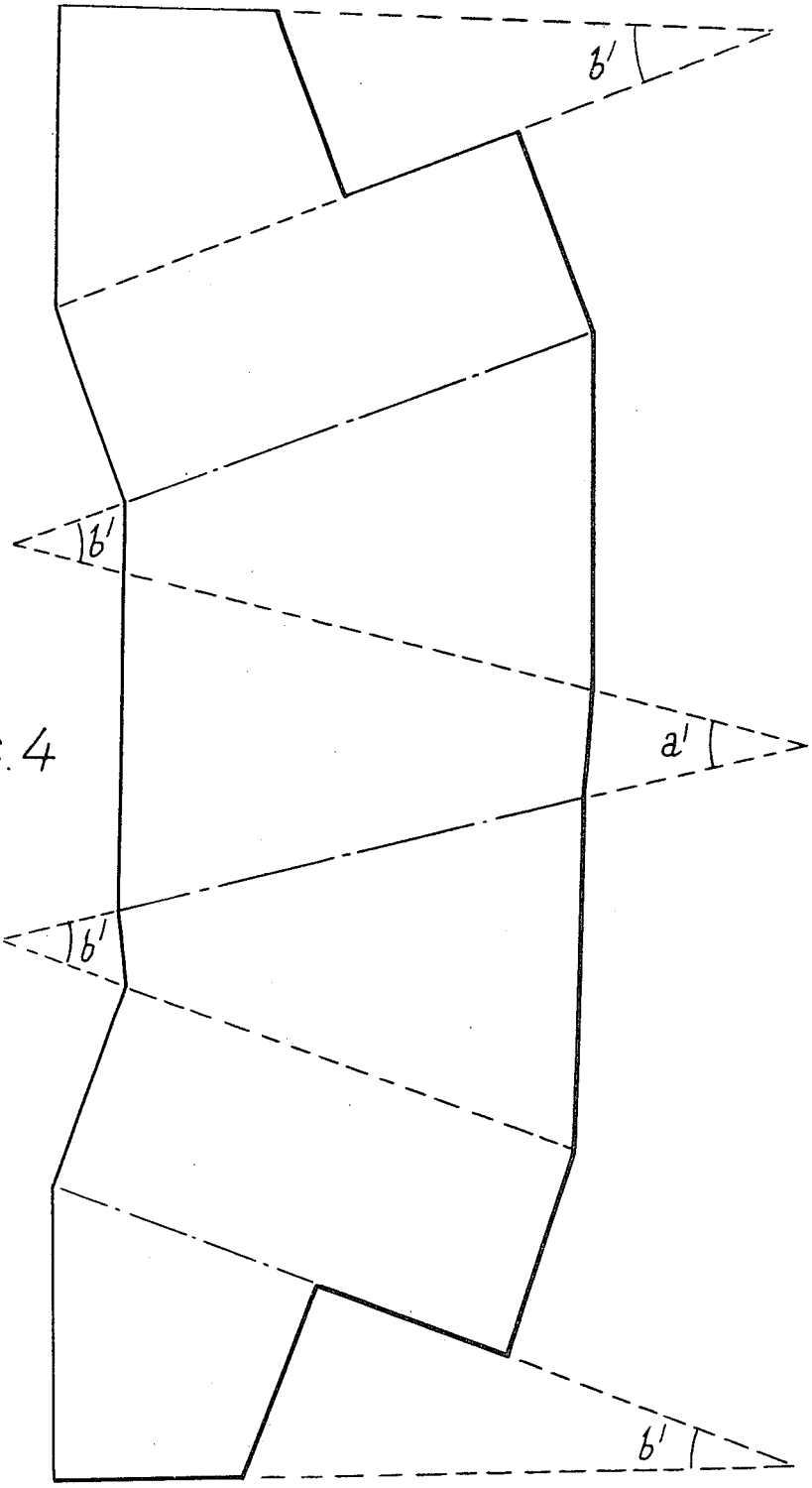

In order that the invention and its various other preferred features may be more readily understood some embodiments thereof will now be described by way of example only with reference to the drawings in which:

FIG. 1 is an elevational view of a radar reflector constructed in accordance with the invention hung from the mast back stay with lines to the guard rails, FIG. 2 is a plan schematic view of the reflector of FIG. 1 shown inside a tubular housing, FIG. 3 illustrates schematically the directional properties of each reflecting element of the arrangement of FIG. 1, FIG. 4 shows a blank strip of metal for bending to form the reflector of FIGS. 1 and 2, FIGS. 5*a* to 5*g* are geometrical schematic illustrations of parts of a dihedral reflector portion useful in deriving manufacturing angles in accordance with a mathematical derivation.

The radar reflector indicated generally at 10 in FIG. 1 is formed of a strip of radar reflective material e.g. 18 s.w.g. sheet aluminium or stainless steel. The strip is folded along axes which extend transversely across the strip in concertina fashion. The folds divide the strip into a series of sections 11, 12, 13 and 14 adjacent ones of which are disposed at right angles.

A flat strip suitable for folding to form the sections is shown in FIG. 4. The chain lines indicate axes at which the fold is to be forwards and the dot and chain lines indicate axes at which the fold is to be backwards. The folds defining the centre section 12 are inclined at a manufacturing angle a' produced from a plan schematic angle a. The two sections 11 adjacent the centre section 12 are defined by folds inclined at a different manufacturing angle b' to that of the centre section which angles are produced from plan schematic angles b. The two sections 13 adjacent these latter sections are defined by folds which are parallel. The end sections 14 are similar to sections 11 except that a portion is cut away to one side of an axis extending at right angles to the fold adjacent the section 13.

The folded strip forms a spine having seven sections, adjacent ones of which are disposed at right angles. Each pair of adjacent surfaces of the sections is provided with a sheet metal divider 15 which is affixed thereto by for example rivetting or welding at right angles to both surfaces to form a pair of corner reflectors in the form of orthogonal re-entrant trihedrals which are capable of acting as elementary reflectors.

The radar reflector can be hung from either end from a point adjacent the axis at which the end section is cut away as shown in FIG. 1. The reflector hanges normally by its own weight with the surfaces of the sections inclined alternately at approximately 45 degrees to the horizontal. Instead of mounting on the mast back stay it may be mounted in any other convenient position e.g. hauled up to the cross tree of a mast.

The maximum reflecting capability of a corner reflector occurs along an axis extending equiangularly between the faces of the corner and this axis may be termed the directional axis of the reflector. When the reflector is hung as previously described the directional axes are inclined above or below the horizontal at a constant angle. As already mentioned the response of a corner reflector falls rapidly outside a solid angle of 36 degrees centred on a directional axis. By accurate positioning of the fold axes the corners can be arranged to cover the full 360 degrees azimuth with negligible gaps between the adjacent (36 degrees) reflection lobe responses of the corner reflectors. In order to provide a satisfactory performance these gaps should not exceed 9 degrees, and to prevent deterioration of response overlap between adjacent (36 degrees) reflection lobes should not be excessive. FIG. 3 shows one possible angular disposition of the fold axes which achieves this target. The drawing indicates the projection of the fold axes of the reflector on to a horizontal plane and it will be appreciated that these fold axes are formed on sections which are in fact inclined about 45 degrees to the horizontal.

FIG. 3 shows one possible construction in which the projection angle a between the fold axes of the centre section 12 is 20 degrees whilst the projection angle b between the fold axes of the adjacent sections is 25 degrees. The centres of reflection from corners are indicated by a circle the non shaded circles indicating reflections from one side of the spine and the shaded circles indicating reflections from the other side of the spine. The numbers against these circles indicate the fold line with which the corner is associated the fold lines being numbered as in FIG. 1. They are also designated left (L) or right (R) dependent upon whether they occur to the right or left of the divider plate 15 when considered in an outwardly directed sense.

The reflector also produces dihedral reflections at right angles to each of the fold lines due to reflection from adjacent sections. These dihedral reflections are indecated by shaded or non shaded rectangles and have the number of the fold with which they are associated to identify them.

The maximum gap between the centres of trihedral responses occurs between 5R and 3R and 4L and 2L and is 45 degrees. This means that a gap between these lobes of (45 degrees − 36 degrees) = 9 degrees occurs.

The minimum gap between the centres of trihedral responses occurs between 2R and 4L and 3R and 5L and is 25 degrees this means that an overlap of (36 degrees − 25 degrees) = 11 degrees occurs.

The diagram of FIGS. 5*a* to 5*g* are helpful in the conversion of projected angles a and b into manufacturing angles a' and b' as shown on the strip in FIG. 4.

The formula is to show the relationship between the angles of the plates and the angles as seen in plan schematic.

The plate shown in FIG. 4 is folded at angles of 90 degrees alternately forwardly and backwardly as shown in FIG. 5*a* so that each portion of the plate is at 45 degrees to the horizontal. The folds are inclined at an angle of $\alpha$ to the horizontal in a direction across the face of the plate as can be seen from the plan schematic view of FIG. 5*b*.

FIG. 5*c* shows schematically lines projected from two adjacent folds onto planes, one horizontal and the other vertical, from which it will be seen that the angle CAO is the design plan angle $\theta$; that the plane ABO is inclined at 45 degrees to the horizontal. Therefore the convergence of the folds in plan equals their convergence in elevation (CAB=CAO).

Lines OC and CB are at right angles to line AC Line AC is equiangular to the fold lines AB and AO Line AC bisecting the angle made by the fold lines may be inclined at an angle to the horizontal. All calculations have been made on the assumption that the angle of inclination will have negligible affect.

Noting the relationship between the right angled triangles OCB ACB ACO in FIGS. 5*d*, 5*e* and 5*f* it can be seen that the hypotenuse of each of these form the isosceles triangles at 5*g*.

A formula for deriving the manufacturing anxle x can be derived as follows:

From FIG. 5e $$\sin \alpha = \frac{CO}{AO} \quad (1)$$

From FIG. 5g $$\sin \frac{x}{2} = \frac{OZ}{AO} \quad (2)$$

From FIG. 5f $$OZ = \frac{CO}{\sqrt{2}} \quad (3)$$

substituting (3) in (2)

$$\sin \frac{x}{2} = \frac{CO}{\sqrt{2}\,AO} = \frac{\sin \alpha}{\sqrt{2}}$$

$$\text{therefore } x = 2 \sin^{-1} \frac{\sin \alpha}{\sqrt{2}}$$

It can be shown that in FIG. 5*g* $x=2 \tan^{-1}\sqrt{2}\cdot\tan(\theta/2)$ and this formula can be used as an alternative for deriving the manufacturing angles.

There is a range of angles which will ensure that the full 360° azimuth are covered with no gap between lobes exceeding 9° with overlapping of less than 11 degrees. Some alternative constructions, derived using the previously obtained formula are shown below but the list is by no means exhaustive.

| Angle a | Angle b | Manufacturing Angle a' | Manufacturing Angle b' | Max. Gap. | Max. Overlap. |
|---|---|---|---|---|---|
| 16° | 26° | 23° | 36° | 6° | 10° |
| 18° | 27° | 25° | 38° | 9° | 9° |
| 12° | 28° | 17° | 39° | 4° | 8° |
| 10° | 30° | 14° | 42° | 4° | 6° |
| 10° | 31° | 14° | 43° | 5° | 5° |

Inspection of the above table reveals that when the angle a falls within the range 10° to 18° and the sum of angle a plus twice angle b falls within the range 68 and 72 then no gap occurs which exceeds 9° and no overlap greater than 11° occurs. The calculations are made on the assumption that the fold lines are horizontal whilst in practice they are angled alternately above and below the horizontal by an angle of approximately 10°. This can require slight compensation of the manufacturing angle. In practice provided the angle a is within the range 10° to 20° and angle a plus twice the angle b is within the range 60°–73° then satisfactory performance is achieved.

It is possible to reduce or eliminate a gap which may occur between 1L and 6R by making the folds defining sections 13 not quite parallel.

The constructions described are particularly advantageous in that the directional axes of the reflection lobes of the individual trihedrals are presented near to the horizontal giving the reflector a more efficient vertical response. It is believed that the constructions described fully meet the stringent performance requirements of the Department of Trade Marine Radar Reflector Performance Specification 1977. In particular, since the response for the vertical plane is also extremely good, the vertical angle response, so important to marine use, exceeds the present requirement, that the vertical coverage be ±15° to the horizontal whilst not falling below −6 dB relative to the required 10 $m^2$ value over any single angle of more than 1.5°. Practical measurement tests have shown that the desired response has still been achieved with angles to the horizontal up to ±30°.

Polar diagrams have been obtained which show both azimuthal and vertical cover to be improved with measured response eight times the theoretical response from a single trihedral corner of the same size as those comprised in the construction being achieved overall with peaks considerably in excess of this level also arising.

Although the spine and divider of the described reflector are formed from a single sheet of material the invention is not restricted to such a construction and any other suitable radar reflective material can be employed. For example, the whole could be moulded from any suitable material which is radar reflective e.g. by injection moulding. Such a moulding could be effected by using a plastics material containing particles of radar reflective material so that these particles are embedded in the moulded reflector. Another possibility is the provision of facings of radar reflective material on a moulded construction e.g. by metal plating or metalization. Another possibility is that the reflector could be made up from modified dihedrals assembled individually on a bar or tube or it may comprise box corners the outer edges of which have been formed to take up the required configuration within a tube.

Another particularly advantageous material from which the reflector can be manufactured is a metal mesh sheet or glass reinforced plastics sheet with a mesh filling. Mesh sheets have been found in some instances to give superior performance to plain metal sheets but the reason for this is not fully understood.

I claim:

1. A radar reflector comprising ten trihedral reflectors directed outwardly of a major axis the inner eight of which are formed in vertically displaced pairs of dihedral reflectors sub-divided by a divider portion which reflectors are positioned such that the apexes of the two central dihedral reflectors are relatively displaced about the major axis by an angle a and the apexes of the dihedral reflectors on each side of the central reflectors are displaced about the major axis relative to the nearest apex of a central dihedral reflector each by an angle different to a, the arrangement being such that the reflectors cover the full azimuth of 360 degrees and the azimuthal spacing between adjacent central axes of reflection of the trihedral reflectors is in the range of 25 degrees to 45 degrees.

2. A radar reflector as claimed in claim 1, wherein the apexes of the dihedral reflectors on each side of the central reflectors are displaced relative to the nearest apex of a central dihedral reflector by the same angle b.

3. A radar reflector as claimed in claim 1 or 2, wherein the angle a falls within the range 10 degrees to 20 degrees and angle a plus twice the angle b falls within the range 68 degrees to 73 degrees.

4. A radar reflector as claimed in claim 1 wherein the dihedral pairs are formed from a single strip of radar reflective material folded alternately forwardly and backwardly at right angles along fold axes spaced apart on, and extending transversely of, the strip.

5. A radar reflector as claimed in claim 1 wherein the reflector is a moulded construction.

6. A radar reflector as claimed in claim 5, wherein the reflector is moulded from a material containing particles of a radar reflective material.

7. A radar reflector as claimed in claim 5, wherein the moulded construction has reflectors formed by facings of radar reflective material.

8. A radar reflector comprising an elongate sheet of reflective material with a major axis, said sheet being folded transversely of said major axis to define on each side of said sheet three dihedral reflectors, the central reflector and a first of the other reflectors of said three dihedral reflectors on each side of said sheet each having a divider wall portion to define two respective pairs of trihedral reflectors, and the second of the other dihedral reflectors on each side of said sheet having a wall portion to define a further trihedral reflector, the apex of the central dihedral reflector on one side of said sheet being displaced about said major axis relative to the apex of the central dihedral reflector on the other side of said sheet by an angle a, and the apexes of the other dihedral reflectors being displaced about said major axis relative to the nearest apex of a said central dihedral reflector each by an angle different from a, and each of said trihedral reflectors having a central axis of reflection, the azimuthal spacing between adjacent ones of said central axes of reflection being in the range 25 degrees to 45 degrees, the arrangement being such that the trihedral reflectors cover the full azimuth of 360 degrees.

9. A radar reflector comprising an elongate sheet of reflective material with a major axis, said sheet being folded transversely of said major axis to define on each side of said sheet three dihedral reflectors, the central reflector and a first of the other reflectors of said three dihedral reflectors on each side of said sheet each having a divider wall portion to define two respective pairs of trihedral reflectors, and the second of the other dihedral reflectors on each side of said sheet having a wall portion to define a further trihedral reflector, the apexes of the central dihedral reflectors on both sides, and the apexes of said first ones of the other dihedral reflectors on both sides having relatively angular displacements about said major axis, the arrangement being such that, considering the apexes in turn from one end of said major axis to the other, said relative angular displacements are in the same rotary sense for each successive pair of adjacent said apexes, and each of said trihedral reflectors having a central axis of reflection, the azimuthal spacing between adjacent ones of said central axes of reflection being in the range 25 degrees to 45 degrees, the arrangement being such that the trihedral reflectors cover the full azimuth of 360 degrees.

10. A radar reflector comprising ten trihedral reflectors arranged along a generally vertical major axis, each of said reflectors being formed from two reflecting walls and a reflecting divider, the first of said reflectors comprising a first wall, a first divider and a first part of the first side of a second wall which meets the first wall along a first apex, the second of said reflectors comprising a first part of the first side of a third wall which meets the second wall along a second apex, a second divider and a first part of the first side of a fourth wall which meets the third wall along a third apex, the third of said reflectors comprising a first part of the first side of a fifth wall which meets the fourth wall along a fourth apex, a third divider and a first part of the first side of a sixth wall which meets the fifth wall along a fifth apex, the fourth of said reflectors comprising a second part of the first side of the third wall, the second divider and a second part of the first side of the fifth wall, the fifth of said reflectors comprising a second part of the first side of the fifth wall, the third divider and a second part of the first part of the sixth wall, the sixth of said reflectors comprising a first part of the second side of the second wall, a fourth divider, and a first part of the second side of the third wall, the seventh of said reflectors comprising a first part of the second side of the fourth wall, a fifth divider, and a first part of the second side of the fifth wall, the eighth of said reflectors comprising a second part of the second side of the second wall, the fourth divider, and a second part of the second side of the third wall, the ninth of said reflectors comprising a second part of the second side of the fourth wall, the fifth divider, and a second part of the second side of the fifth wall, and the tenth of said reflectors comprising a second part of the second side of the sixth wall, a sixth divider, and a seventh wall, which meets the sixth wall along a sixth apex, the third and fourth apexes being relatively displaced about the major axis by an angle a, the second and fifth apexes being displaced about the major axis relative to the third and fourth apexes respectively by an angle different from a, and the ten trihedral reflectors each having a respective central axis of reflection, said ten central axes of reflection being distributed so that the azimuthal spacing between adjacent central axes of reflection lies in the range of 25 degrees to 45 degrees, the arrangement being such that the ten trihedral reflectors cover the full azimuth of 360 degrees.

* * * * *